US009487889B2

(12) United States Patent
Smith et al.

(10) Patent No.: US 9,487,889 B2
(45) Date of Patent: Nov. 8, 2016

(54) BI-COMPONENT SPANDEX WITH SEPARABLE REDUCED FRICTION FILAMENTS

(75) Inventors: Steven W. Smith, Waynesboro, VA (US); Raymond S. P. Leung, Shatin (HK)

(73) Assignee: INVISTA North America S.a.r.l., Wilmington, DE (US)

( * ) Notice: Subject to any disclaimer, the term of this patent is extended or adjusted under 35 U.S.C. 154(b) by 396 days.

(21) Appl. No.: 13/997,831

(22) PCT Filed: May 18, 2011

(86) PCT No.: PCT/US2011/036953

§ 371 (c)(1),
(2), (4) Date: Jun. 25, 2013

(87) PCT Pub. No.: WO2012/091750

PCT Pub. Date: Jul. 5, 2012

(65) Prior Publication Data

US 2013/0298519 A1 Nov. 14, 2013

Related U.S. Application Data

(60) Provisional application No. 61/427,515, filed on Dec. 28, 2010.

(51) Int. Cl.

| | |
|---|---|
| ***D02G 3/36*** | (2006.01) |
| ***D02G 3/32*** | (2006.01) |
| ***D01F 8/16*** | (2006.01) |

(52) U.S. Cl.
CPC *D02G 3/36* (2013.01); *D01F 8/16* (2013.01); *D02G 3/32* (2013.01)

(58) Field of Classification Search
CPC ..... D02G 3/32; D02G 3/36
See application file for complete search history.

(56) References Cited

U.S. PATENT DOCUMENTS

| | | | | |
|---|---|---|---|---|
| 3,094,374 | A | 6/1963 | Smith | |
| 5,162,074 | A | 11/1992 | Hills | |
| 5,256,050 | A | 10/1993 | Davies | |
| 5,723,080 | A | 3/1998 | Bruner et al. | |
| 5,849,410 | A | 12/1998 | Nelson et al. | |
| 6,562,456 | B1 * | 5/2003 | Bruner et al. | 428/364 |

(Continued)

FOREIGN PATENT DOCUMENTS

| | | |
|---|---|---|
| JP | 03059112 | 3/1991 |
| WO | 2006102249 A2 | 9/2006 |

(Continued)

OTHER PUBLICATIONS

Ziabicki, Andrezij. Fundamentals of Fibre Formation—The Science of Fibre Spinning and Drawing, 1976, p. 366-375, John Wiley and Sons, London/New York.

(Continued)

*Primary Examiner* — Shaun R Hurley
(74) *Attorney, Agent, or Firm* — Bridget C. Sciamanna

(57) ABSTRACT

Disclosed herein are spandex fibers having reduced friction combined to provide a multiple end spandex package. The spandex fibers have a sheath-core cross-section with a lubricating additive is included in the sheath. A fusing additive specifically excluded to avoid coalescence among the individual filaments in the yarn. When combined in a yarn package, the multiple filaments are separable.

15 Claims, 6 Drawing Sheets

(56) References Cited

U.S. PATENT DOCUMENTS

| | | | | |
|---|---|---|---|---|
| 2006/0135021 | A1 | 6/2006 | Calhoun et al. | |
| 2009/0269582 | A1 | 10/2009 | Hiraishi et al. | |
| 2015/0044448 | A1* | 2/2015 | Smith | 428/221 |

FOREIGN PATENT DOCUMENTS

| | | | |
|---|---|---|---|
| WO | 2007123214 | A1 | 11/2007 |
| WO | 2010045155 | A2 | 4/2010 |

OTHER PUBLICATIONS

Jeffries, R. Bi-component Fibres, 1971, p. 1-3, Merrow Publishing Co. Ltd, England.

Cooke, T.F. Bicomponent Fibers, Handbook of Fiber Science and Technology, 1993, p. 247-252, T.F. Cooke, TRI/Princeton.

* cited by examiner

BI-COMPONENT SPANDEX WITH SEPARABLE REDUCED FRICTION FILAMENTS

BACKGROUND OF THE INVENTION

1. Field of the Invention

Included are multiple component spandex yarns that include a release agent. Multiple filaments of the yarns are wound onto the same package to provide a multiple end package with separable spandex filaments.

2. Description of the Related Art

Spandex elastomeric yarns can offer high stretch, good recovery from extension and good fit to the articles made from them, such as weft knit, warp knit, woven fabrics and other textiles. However, the spandex substrate suffers from high tack and friction which can limit commercial applications. Excessive tack is often expressed as fused filament segments and high yarn-to-yarn friction. Also, on being unwound from a yarn package, spandex filaments can experience excessive tension and large, rapid transient increases in tension, which in turn lead to broken filaments during operations such as covering, knitting, weaving and the like. Such tension variations produce non-uniformities in fabrics made with spandex fiber supplied from such packages.

Existing production methods for spandex yarns are based on coalesced multifilament yarns where individual filaments forming the overall yarns are bound together during spinning by pneumatic or mechanical twisting mechanisms in the dry-spinning process.

A process for producing coalesced spandex yarns is described for example in U.S. Pat. No. 3,094,374 which outlines advantages of a multifilament yarn with high interfilament adhesion with regard to consistent processing and discloses methods for achieving such yarns. However, many textile goods and processes benefit from monofilament spandex yarns where fabric sheerness or low elastic power is desirable. Commercial costs for production of monofilament spandex yarns can be significantly higher due to low asset utilization when compared to multi-filament elastic yarns. JP 03-059112 describes bundled polyurethane multifilaments or monofilaments which are wound up on a bobbin in an oriented manner so that the bundled multi- or monofilaments require 15 mg or less for separation from the bobbin. They are further processed as separate multifilaments or monofilaments at a speed of at least 150 m/min. These products are obtained by subjecting the dry-spun filaments to cooling below 60° C. and by coating the product with a metal soap. U.S. Pat. No. 5,723,080 describes a process for the production of splittable (separable) spandex yarns from a dry spinning process wherein the coalescence of individual filaments is prevented, through the use of widely-spaced spinning jets, laminarized gas flow, and individualized thread guides.

Co-pending PCT Patent Application Publication WO2010/045155, which is incorporated by reference in its entirety, describes spandex fibers prepared by a solution-spinning process where the cross-section includes at least two separate regions with definable boundaries where at least one region defined by the boundaries of the cross-section includes a spandex composition. Examples of cross-sections disclosed include side-by-side and sheath-core.

SUMMARY OF THE INVENTION

There is a need for yarns that can provide enhanced efficiency for using spandex including segmented polyurethane-urea elastic fibers having enhanced functionality and commercial value via a sheath-core bi-component construction. More particularly an embodiment relates to a splittable (separable) spandex multifilament yarns whereby surface modification of the fiber prevents coalescence of the individual filaments forming the yarn due to fusion, adhesion, entangling or plying. The separable multifilament yarns result in a multiple end yarn package of monofilament yarns which are especially useful for light-weight fabrics and sheer garments.

Some embodiments combine the superior stretch and recovery of fibers based on solution-spun spandex compositions with a surface modifier in a bi-component fiber structure to satisfy market demand for economical monofilament spandex yarns. The polyurea-polyurethanes are prepared by methods known in the art. One common method is the synthesis of the fiber raw materials by the prepolymer process, in which, in a first step, a long-chain diol is reacted, in a solvent, with a diisocyanate to form a prepolymer so that the reaction product contains isocyanate end groups (NCO groups). The prepolymer is extended in a second step with bi-functional alcohols or amines to form the final polymer.

The present invention provides a low-friction spandex elastomeric yarn by dry-spinning a bi-component, sheath-core fiber where the sheath includes:

A. a "release agent," such as a characteristic crystalline material which shears into thin, flat platelets which readily fracture, non-limiting examples of suitable compositions include mica, graphite, talc, boron nitride, and mixtures thereof, and B. a polyurethane or polyurethane-urea with satisfactory elastic performance and the core includes a segmented polyurethane.

The spandex multifilament yarns of some embodiments exhibit high uniformity and an excellent textile processing behavior and do not differ from conventionally produced spandex, also referred to as elastane yarn, spun directly to the final linear density. Robust filament separation enables multiple monofilament fine yarns corresponding to the number of individual filaments to be combined onto one package. This provides a multiple end (multi-end) package which considerably increases the efficiency of the manufacturing process. Utilization of some embodiments increases the amount of fine (<30 denier or <33 dtex) spandex yarn by multiples obtained from a conventional spinning process and offers economic advantages to the textile processor.

Some aspects provide an article including a low-friction spandex elastomeric yarn including:

(a) a polyurethane bi-component fiber having a core and a sheath; and (b) a release agent which also serves the purpose of a lubricating additive;

wherein the elastomeric yarn is a single filament yarn or fiber.

Another aspect provides an article including a package or cake of bi-component polyurethane yarn, where:

(a) the bi-component polyurethane yarn has a sheath and a core;

(b) the sheath includes a release agent; and (c) the yarn includes multiple, separable filaments.

Also included is a method including:

(a) providing a package of bi-component polyurethane yarn;

wherein:

(1) the bi-component polyurethane yarn has a sheath and a core;

(2) the sheath includes a release agent; and (3) the yarn includes multiple, separable filaments;

(b) unwinding the polyurethane yarn; and (c) separating the multiple, separable filaments.

A fusing additive should be omitted for the single filament yarn packages where cohesive bonding among filaments in the same yarn would reduce or prevent the yarns from being separable.

DETAILED DESCRIPTION OF THE INVENTION

Definitions

Figure 1:
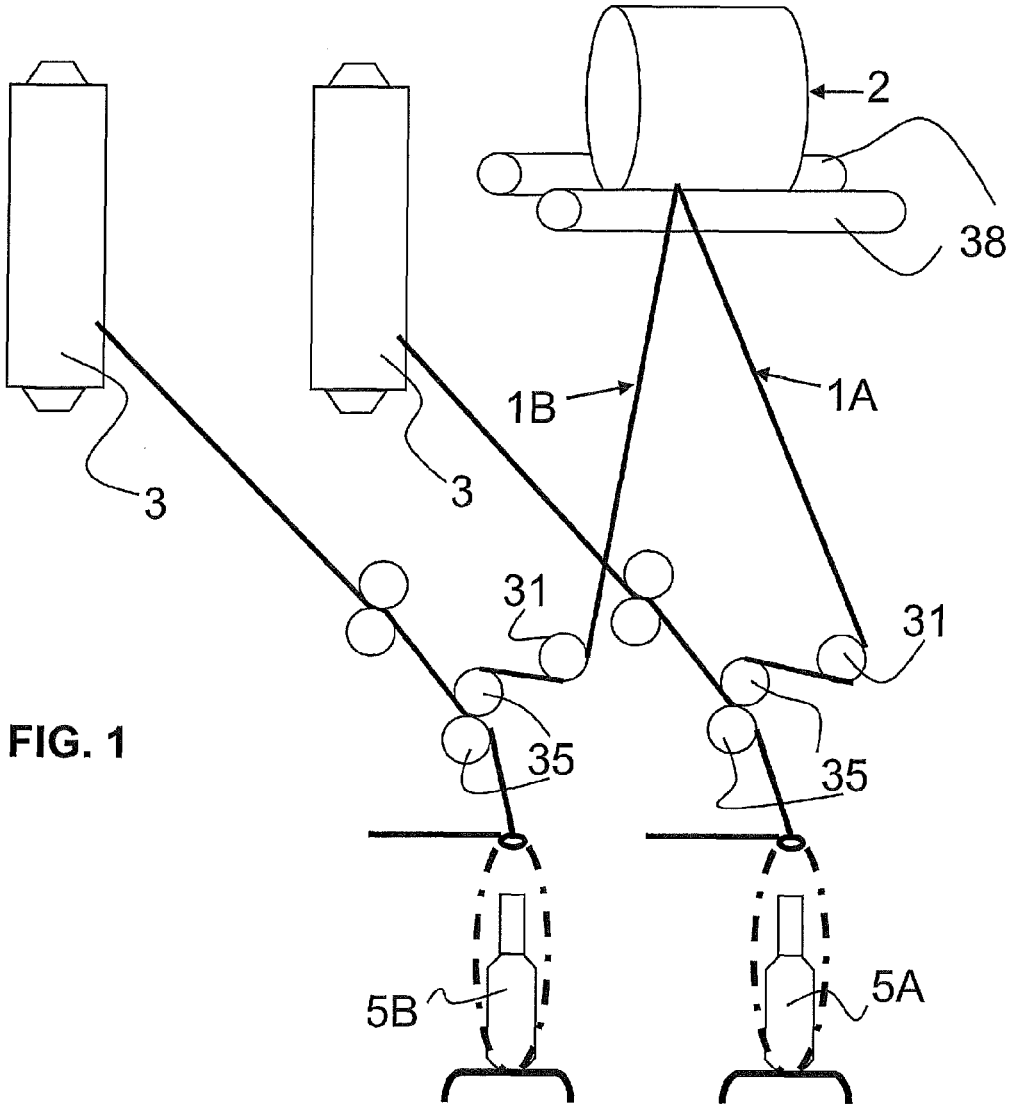
FIG. 1 is a schematic representation of the preparation of core-spun covered yarn from a multi-end spandex package.

The term "multiple component fiber" as used herein means a fiber having at least two separate and distinct regions of different compositions with a discernable boundary, i.e., two or more regions of different compositions that are continuous along the fiber length. This is in contrast to polyurethane or polyurethaneurea blends wherein more than one composition is combined to form a fiber without distinct and continuous boundaries along the length of the fiber. The terms, "multiple component fiber" and "multicomponent fiber" are synonymous and are used interchangeably herein. Within this definition, a "bi-component fiber" has two separate and distinct regions.

The term "compositionally different" is defined as two or more compositions including different polymers, copolymers or blends or two or more compositions having one or more different additives, where the polymer included in the compositions may be the same or different. Two compared compositions are also "compositionally different" where they include different polymers and different additives.

The terms "boundary," "boundaries," and "boundary region" are used to describe the point of contact between different regions of the multicomponent fiber cross-section. This point of contact is "well-defined" where there is minimal or no overlap between the compositions of the two regions. Where overlap does exist between two regions, the boundary region will include a blend of the two regions. This blended region may be a separate homogenously blended section with separate boundaries between the blended boundary region and each of the other two regions. Alternatively, the boundary region may include a gradient of higher concentration of the composition of the first region adjacent to the first region to a higher concentration of the composition of the second region adjacent to the second region.

As used herein, "solvent" refers to an organic solvent such as N,N-dimethylacetamide (DMAC), N,N-dimethylformamide (DMF) and N-methylpyrrolidone.

The term "solution-spinning" as used herein includes the preparation of a fiber from a solution which can be either a wet-spun or dry-spun process, both of which are common techniques for fiber production. The multiple component or bi-component fibers may be prepared by a solution-spun process and as such may be described as solution-spun yarn.

The term "core-spun yarn" as used herein includes yarn made by twisting fibers around a filament, thus concealing the core. Often the core yarn is an elastic spandex yarn to impart stretch-recovery character and covering fiber is cotton to obtain desirable touch aesthetic.

As used herein, "threadline" means a single or a group of spandex filaments. The filaments of the threadline are processed together, as a group. As used herein, "end" means an individual fiber, yarn, or threadline. As used herein, "threadline" is interchangeable with "end". In conventional fiber spinning and winding processes, a single threadline is typically wound onto a single tube core to produce a "single-end" package. The single end package produced by the conventional procedure is also referred to as "one end per package."

Some aspects provide bi-component fibers including a solution-spun segmented polyurethane composition, which is also referred to as spandex or elastane. The compositions for the different regions of the bi-component fibers include different polyurethane-polyurea compositions in that the polymer is different, the additives are different, or both the polymer and additives are different. By providing a bi-component fiber, a variety of different benefits can be realized such as reduced cost and higher efficiency.

Some aspects provide a novel surface structure for spandex fiber which reduces the fiber friction, decreases tackiness, and sustains robust separation of a multifilament yarn under low tension. The individual filaments must not be twisted, plied, or entangled along the length of the fiber in order to satisfy robustness in commercial textile processing. The splittable/separable bi-component fibers of the invention are generally made by extruding a plurality of bi-component filaments and winding on to a single package. Traditionally, high additive loadings have deleterious effects on spandex fiber properties, but implementation within a bi-component structure provides greater flexibility to use high additive levels (such as greater than about 10%) in the sheath component while improving product delivery in textile knitting and covering operations without loss of elastic performance.

The surface modification of the fibers is achieved by a manufacturing process for producing splittable spandex multifilament yarns from conventional polyurethane-polyurea materials by means of a bi-component solution-spinning process (dry or wet-spinning), which includes:

1) Blending a sheath solution including high levels of release agents with polyurethane-polyureas;

2) Solution spinning the sheath solution with unmodified polyurethane-polyurea core material to provide at least two bi-component yarns which are combined to form a multifilament yarn;

3) Winding the multifilament yarns onto a single package to provide a multi-end package, and optionally 4) Separating the multi-filament yarns into single monofilament yarns during subsequent textile processing steps.

Some aspects avoid the need for cooling of the filaments and after-treatment with metallic soap as in JP 03-059 112. Furthermore, specialized configuration of the capillary geometry, laminarization of gas flow, and individualized guides, as described for example in U.S. Pat. No. 5,723,080 are not necessary.

In some aspects the spandex yarn includes strands of filaments and can be processed in such a way that the filaments are easily and robustly separable upon unwinding. The product can be used by positive delivery device as a multi-end package in processes such as core spinning, hollow spindle (single and double) covering, circular knitting, elastic yarn warp beaming and replace multiple single-end packages, which provides convenience and cost savings for textile manufacturers. The multiple filament yarn may include any suitable number of filaments that are separable to individual monofilament yarns such as 2 filaments to 10 filaments per multiple filament yarn.

Included are reduced friction/low friction bi-component spandex/elastane yarns that can be used in combination with traditional finishes such as silicon or mineral oil based finishes to provide a low-friction fiber. These fibers have one or more of the following properties: high resistance to thermal creep, good elasticity, low-friction, and robust filament cohesion. These attributes are ideally suited for textile applications such as light-weight circular-knit, warp-knit and woven fabrics, but are also useful for any fabrics and garments that require an elastic yarn.

The yarns of some aspects are multiple filament yarns. The yarns include a release agent which may also be a lubricating additive which contributes to the reduced friction property. The multiple filament yarns also must exclude a fusing additive, to ensure that they will be separable. The purpose of the fusing additive is to enhance or provide cohesion among filaments in a multiple filament yarn, which is avoided for the multi-end packages which include splittable/separable yarns.

The release agent may also be referred to as a lubricating additive due to the ability to provide a reduced friction surface to the spandex. The release agent may be a crystalline material which fractures, a low-friction polymer or a combination of two or more of these. Examples of solid lubricants useful as the release agent include crystalline materials which shear into thin, flat platelets and readily slide over one another to produce a lubricating effect. Non-limiting examples of suitable release agents include mica, graphite, carbon black, molybdenum disulfide, talc, boron nitride, fumed silica, a variety of waxes, and mixtures thereof. Also included are highly electronegative polymers such as a fluorine-containing polymer. These can be low friction polymers, such as PTFE which is widely used to reduce friction.

Talcs may be hydrated magnesium silicates frequently including aluminium silicate. The crystal structure of talc may include of repeated layers of a sandwich of brucite (magnesium hydroxide) between layers of silica.

Micas may include aluminium silicates and optionally include iron and/or alkali metals. Micas are able to divide into thin layers (about 1 μm). They generally range in size from 5 to 150 μm, preferably from 10 to 100 μm and better still from 10 to 60 μm for the largest size (length), and a height (thickness) of from 0.1 to 0.5 μm. The micas may include phlogopite, muscovite, fluorophlogopite vermiculite, micaceous clays such as illite, and mixtures thereof.

The bi-component fibers of some aspects can include a wide range of ratio of the first region (core) to the second region (sheath). The sheath in a sheath-core configuration, can be present in an amount from about 1% to about 60% based on the weight of the fiber including from about 1% to about 50% by weight of the fiber, from about 10% to about 35% by weight of the fiber, about 10% to about 20%, about 10% to about 15% and from about 5% to about 30% by weight of the fiber. Where desired to limit the effect of the sheath on the elastic properties of the core, the sheath may be minimized.

The amounts of the release agent/lubricating additive may vary. The release agent/lubricating additive can be used either alone, or in combination with a polyurethane or polyurethaneurea composition and/or additional polymers and additives. The release agent may be present in an amount from about 1% to about 50% by weight of the sheath, including about 5% to about 25%, 10% to about 25%, and about 10% to about 15%.

Some aspects include multi-component, or bi-component fibers including a solution-spun polymer composition. A variety of different compositions are suitable including a polyurethane, a polyurethaneurea or a mixture thereof. The compositions for the different regions of the multi-component fibers include different polyurethane or polyurethaneurea compositions in that the polymer is different, the additives are different, or both the polymer and additives are different. By providing a multiple component fiber, a variety of different benefits can be realized. For example, improved fiber properties can be realized by the introduction of new additives that would be incompatible with a conventional monocomponent spandex yarn or through a synergistic effect of combining two compositions.

The linear density of the fiber may be produced from 5-2000 dtex based on the desired fabric construction. A spandex yarn of 5-70 dtex and may have a filament count of between 1 and 5, and a yarn of 70-2000 dtex may have a filament count from 5 to 200, including from 20 to 200. The fiber may be used in fabrics of any sort (wovens, warp knits, or weft knits) with content from 0.5% to 100% depending on the desired end use of the fabric.

The spandex fiber may have a lubricant or finish applied to it during the manufacturing process to improve downstream processing of the fiber. The finish, such as a silicone or mineral oil-based finish, may be applied in a quantity of 0.5 to 10% by weight.

Polyurethaneurea and Polyurethane Compositions

A variety of different polyurethane or polyurethaneurea compositions are useful with the present invention in either or both of the first and second regions (i.e., the core and the sheath, respectively). Additional regions may also be included. Useful polyurethane/polyurethaneurea compositions are described in detail below.

The properties of polyurethane block copolymers depend on phase separation of the urethane and polyol segments, such that the hard urethane domains serve as crosslinks in the soft-segment matrix. The urethane domain is controlled by both content and quality of the selected chain extender. When the chain extender is a diol, the result is a polyurethane; when the chain extender is water or a diamine, the result is a polyurethaneurea.

Those of skill in the art will recognize that a wide variety of diol chain extenders are useful with the present invention. One suitable example of commercial diol chain extenders useful for the preparation of high melting point polyurethanes include, without limitation, ethylene glycol, 1,3-propanediol (PDO), 1,4-butanediol (1,4-BDO or BDO), and 1,6-hexanediol (HDO).

Those of skill in the art will recognize that a variety of different polyurethane and polyurethaneurea compositions are suitable for the present invention. These include, but are not limited to polyurethaneurea compositions useful including long chain synthetic polymers that include at least 85% by weight of a segmented polyurethane. Typically, these include a polymeric glycol, also referred to as a polyol, which is reacted with a diisocyanate to form an NCO-terminated prepolymer (a "capped glycol"), which is then dissolved in a suitable solvent, such as N,N-dimethylacetamide, N,N-dimethylformamide, or N-methylpyrrolidone, and secondarily reacted with a difunctional chain extender.

Polyurethanes are formed when the chain extenders are diols (and may be prepared without solvent). Polyurethaneureas, a sub-class of polyurethanes, are formed when the chain extenders are diamines. In the preparation of a polyurethaneurea polymer which can be spun into spandex, the glycols are extended by sequential reaction of the hydroxy end groups with diisocyanates and one or more diamines. In each case, the capped glycols must undergo chain extension to provide a polymer with the necessary properties, including viscosity. If desired, dibutyltin dilaurate, stannous octoate, mineral acids, tertiary amines such as triethylamine, N,N'-dimethylpiperazine, and the like, and other known catalysts can be used to assist in the capping step.

Non-limiting examples of suitable polymeric glycol components include polyether glycols, polycarbonate glycols, and polyester glycols of number average molecular weight of about 600 to about 3,500. Mixtures of two or more polymeric glycol or copolymers can be included.

Non-limiting examples of suitable polyether glycols that can be used include those glycols with two or more hydroxy groups, from ring-opening polymerization and/or copolymerization of ethylene oxide, propylene oxide, trimethylene oxide, tetrahydrofuran, and 3-methyltetrahydrofuran, or from condensation polymerization of a polyhydric alcohol, such as a diol or diol mixtures, with less than 12 carbon atoms in each molecule, such as ethylene glycol, 1,3-propanediol, 1,4-butanediol, 1,5-pentanediol 1,6-hexanediol, 2,2-dimethyl-1,3 propanediol, 3-methyl-1,5-pentanediol, 1,7-heptanediol, 1,8-octanediol, 1,9-nonanediol, 1,10-decanediol and 1,12-dodecanediol. A linear, bifunctional polyether polyol is preferred, and a poly(tetramethylene ether) glycol of molecular weight of about 1,700 to about 2,100, such as Terathane® 1800 (INVISTA of Wichita, Kans.) with a functionality of 2, is one example of a specific suitable glycols. Co-polymers can include poly (tetramethyleneether-co-ethyleneether) glycol.

Non-limiting examples of suitable polyester polyols that can be used include those ester glycols with two or more hydroxy groups, produced by condensation polymerization of aliphatic polycarboxylic acids and polyols, or their mixtures, of low molecular weights with no more than 12 carbon atoms in each molecule. Examples of suitable polycarboxylic acids are malonic acid, succinic acid, glutaric acid, adipic acid, pimelic acid, suberic acid, azelaic acid, sebacic acid, undecanedicarboxylic acid, and dodecanedicarboxylic acid. Examples of suitable polyols for preparing the polyester polyols are ethylene glycol, 1,3-propanediol, 1,4-butanediol, 1,5-pentanediol 1,6-hexanediol, neopentyl glycol, 3-methyl-1,5-pentanediol, 1,7-heptanediol, 1,8-octanediol, 1,9-nonanediol, 1,10-decanediol and 1,12-dodecanediol. A linear bifunctional polyester polyol with a melting temperature of about 5° C. to about 50° C. is an example of a specific polyester polyol.

Non-limiting examples of suitable polycarbonate polyols that can be used include those carbonate glycols with two or more hydroxy groups, produced by condensation polymerization of phosgene, chloroformic acid ester, dialkyl carbonate or diallyl carbonate and aliphatic polyols, or their mixtures, of low molecular weights with no more than 12 carbon atoms in each molecule. Examples of suitable polyols for preparing the polycarbonate polyols are diethylene glycol, 1,3-propanediol, 1,4-butanediol, 1,5-pentanediol, 1,6-hexanediol, neopentyl glycol, 3-methyl-1,5-pentanediol, 1,7-heptanediol, 1,8-octanediol, 1,9-nonanediol, 1,10-decanediol and 1,12-dodecanediol. A linear, bifunctional polycarbonate polyol with a melting temperature of about 5° C. to about 50° C. is an example of a specific polycarbonate polyol.

Non-limiting examples of suitable diisocyanate components can include a single diisocyanate or a mixture of different diisocyanates including an isomer mixture of diphenylmethane diisocyanate (MDI) containing 4,4'-methylene bis(phenyl isocyanate) and 2,4'-methylene bis(phenyl isocyanate). Any suitable aromatic or aliphatic diisocyanate can be included. Examples of diisocyanates that can be used include, but are not limited to 4,4'-methylene bis(phenyl isocyanate), 2,4'-methylene bis(phenyl isocyanate), 4,4'-methylenebis(cyclohexyl isocyanate), 1,3-diisocyanato-4-methyl-benzene, 2,2'-toluenediisocyanate, 2,4'-toluenediisocyanate, and mixtures thereof.

A chain extender may be either water or a diamine chain extender for a polyurethaneurea. Combinations of different chain extenders may be included depending on the desired properties of the polyurethaneurea and the resulting fiber. Non-limiting examples of suitable diamine chain extenders include: hydrazine; 1,2-ethylenediamine; 1,4-butanediamine; 1,2-butanediamine; 1,3-butanediamine; 1,3-diamino-2,2-dimethylbutane; 1,6-hexamethylenediamine; 1,12-dodecanediamine; 1,2-propanediamine; 1,3-propanediamine; 2-methyl-1,5-pentanediamine; 1-amino-3,3,5-trimethyl-5-aminomethylcyclohexane; 2,4-diamino-1-methylcyclohexane; N-methylamino-bis(3-propylamine); 1,2-cyclohexanediamine; 1,4-cyclohexanediamine; 4,4'-methylene-bis(cyclohexylamine); isophorone diamine; 2,2-dimethyl-1,3-propanediamine; meta-tetramethylxylenediamine; 1,3-diamino-4-methylcyclohexane; 1,3-cyclohexane-diamine; 1,1-methylene-bis(4,4'-diaminohexane); 3-aminomethyl-3,5,5-trimethylcyclohexane; 1,3-pentanediamine (1,3-diaminopentane); m-xylylene diamine; and Jeffamine® (Huntsman).

When a polyurethane is desired, the chain extender is a diol. Examples of such diols that may be used include, but are not limited to, ethylene glycol, 1,3-propanediol, 1,2-propylene glycol, 3-methyl-1,5-pentanediol, 2,2-dimethyl-1,3-propanediol, 2,2,4-trimethyl-1,5-pentanediol, 2-methyl-2-ethyl-1,3-propanediol, 1,4-bis(hydroxyethoxy)benzene, and 1,4-butanediol, hexanediol and mixtures thereof.

A monofunctional alcohol or a primary/secondary monofunctional amine may optionally be included to control the molecular weight of the polymer. Blends of one or more monofunctional alcohols with one or more monofunctional amines may also be included.

Non-limiting examples of suitable monofunctional alcohols useful in some aspects include at least one member selected from the group consisting of aliphatic and cycloaliphatic primary and secondary alcohols with 1 to 18 carbons, phenol, substituted phenols, ethoxylated alkyl phenols and ethoxylated fatty alcohols with molecular weight less than about 750, including molecular weight less than 500, hydroxyamines, hydroxymethyl and hydroxyethyl substituted tertiary amines, hydroxymethyl and hydroxyethyl substituted heterocyclic compounds, and combinations thereof, including furfuryl alcohol, tetrahydrofurfuryl alcohol, N-(2-hydroxyethyl)succinimide, 4-(2-hydroxyethyl)morpholine, methanol, ethanol, butanol, neopentyl alcohol, hexanol, cyclohexanol, cyclohexanemethanol, benzyl alcohol, octanol, octadecanol, N,N-diethylhydroxylamine, 2-(diethylamino)ethanol, 2-dimethylaminoethanol, and 4-piperidineethanol, and combinations thereof.

Non-limiting examples of suitable mono-functional dialkylamine blocking agents include: N,N-diethylamine, N-ethyl-N-propylamine, N,N-diisopropylamine, N-tert-butyl-N-methylamine, N-tert-butyl-N-benzylamine, N,N-dicyclohexylamine, N-ethyl-N-isopropylamine, N-tert-butyl-N-isopropylamine, N-isopropyl-N-cyclohexylamine, N-ethyl-N-cyclohexylamine, N,N-diethanolamine, and 2,2,6,6-tetramethylpiperidine.

Other Polymers

Other polymers that are useful for inclusion in one or more regions of the multiple component fibers of some aspects include other polymers which are soluble or have limited solubility or can be included in particulate form (e.g., fine particulate). The polymers may be dispersed or dissolved in the polyurethane or—polyurethaneurea solution or coextruded with the solution spun-polyurethane or polyurethaneurea composition. The result of co-extrusion can be a bi-component or multiple component fiber having a side-by-side, concentric sheath-core, or eccentric sheath-core cross-section where one component is polyurethaneurea solution and the other component contains another polymer. Examples of other polymers include low-melting polyurethanes (as described above), polyamides, acrylics, polyaramides, and polyolefins, among others.

Fiber Cross-Section Configurations

A variety of different cross-sections are useful with the invention of some embodiments. These include bi-component or multiple component concentric or eccentric sheath-core and bi-component or multiple component side-by-side. Unique cross-sections are contemplated, so long as the cross-sections will include at least two separate regions. To maximize the separability of the multifilament yarns, a sheath-core cross-section can be included where the release agent is included in at least the sheath, but may also be included in the core depending on the desired yarn properties.

Each of the sheath-core cross-sections includes a boundary area between at least two compositionally different polyurethaneurea compositions. The boundary may be a well-defined boundary or may include a blended region. Where the boundary includes a blended region, the boundary itself is a distinct region which is a blend of the compositions of the first and second (or third, fourth, etc.) regions. This blend may be either a homogenous blend or may include a concentration gradient from the first region to the second region.

Additives

Classes of additives that may be optionally included in polyurethane or polyurethaneurea compositions are listed below. An exemplary and non-limiting list is included. However, additional additives are well-known in the art. Examples include: anti-oxidants, UV stabilizers, colorants, pigments, cross-linking agents, organic and inorganic fillers, stabilizers (hindered phenols, zinc oxide, hindered amine), slip agent (silicone oil) and combinations thereof.

The additive may provide one or more beneficial properties including: dyeability, hydrophobicity (i.e., polytetrafluoroethylene (PTFE)), hydrophilicity (i.e., cellulose), friction control, chlorine resistance, degradation resistance (i.e., antioxidants), color, tack control (i.e., metal soaps), tactile properties, set-ability, delustrant such as titanium dioxide, stabilizers such as hydrotalcite, a mixture of huntite and hydromagnesite, UV screeners, and combinations thereof.

Additives may be included in any amount suitable to achieve the desired effect.

Apparatus

Bi-component fibers have been typically prepared by a melt-spinning process. The apparatuses used for these processes can be adapted for use with a solution-spinning process. Dry-spinning and wet-spinning are solution-spinning processes that are well-known.

Convenient references relating to fibers and filaments, including those of man-made bi-component fibers, and incorporated herein by reference, are, for example:

a. Fundamentals of Fibre Formation—The Science of Fibre Spinning and Drawing, Adrezij Ziabicki, John Wiley and Sons, London/New York, 1976;
b. Bi-component Fibres, R Jeffries, Merrow Publishing Co. Ltd, 1971;
c. Handbook of Fiber Science and Technology, T. F. Cooke, CRC Press, 1993;

Similar references include U.S. Pat. Nos. 5,162,074 and 5,256,050 incorporated herein by reference, which describes methods and equipment for bi-component fiber production.

Extrusion of the polymer through a die to form a fiber is done with conventional equipment such as, for example, extruders, gear pumps and the like. It is preferred to employ separate gear pumps to supply the polymer solutions to the die. When blending additives for functionality, the polymer blend is preferably mixed in a static mixer, for example, upstream of the gear pump in order to obtain a more uniform dispersion of the components. Preparatory to extrusion each spandex solution can be separately heated by a jacketed vessel with controlled temperature and filtered to improve spinning yield.

The bi-component spandex fibers may also be prepared by separate capillaries to form separate filaments which are subsequently coalesced to form a single fiber.

Process of Making Fibers

The fiber of some embodiments is produced by solution spinning (either wet-spinning or dry-spinning) of the—polyurethane or polyurethane-urea polymer from a solution with conventional urethane polymer solvents (e.g., DMAc). The polyurethane or polyurethaneurea polymer solutions may include any of the compositions or additives described above. The polymer is prepared by reacting an organic diisocyanate with appropriate glycol, at a mole ratio of diisocyanate to glycol in the range of 1.6 to 2.3, preferably 1.8 to 2.0, to produce a "capped glycol". The capped glycol is then reacted with a mixture of diamine chain extenders. In the resultant polymer, the soft segments are the polyether/urethane parts of the polymer chain. These soft segments exhibit melting temperatures of lower than 60° C. The hard segments are the polyurethane/urea parts of the polymer chains; these have melting temperatures of higher than 200° C. The hard segments amount to 5.5 to 12%, preferably 6 to 10%, of the total weight of the polymer. A polyurethane polymer is prepared by reacting an organic diisocyanate with appropriate glycol, at a mole ratio of diisocyanate to glycol in the range of 2.2 to 3.3, preferably 2.5 to 2.95, to produce a "capped glycol". The capped glycol is then reacted with a mixture of diol chain extenders. The hard segments are the polyurethane segments of the polymer chains; these have melting temperatures ranging from 150-240° C. The hard segments can constitute 10 to 20%, preferably 13, of the total weight of the polymer.

Yarns and fabrics can be prepared from the elastic multiple component fibers described herein by any conventional means. The elastic yarns can be covered with a second yarn, such as a hard yarn. Suitable hard yarns include nylon, acrylic, cotton, polyester and mixtures thereof, among others. Covered yarns can include single covered, double covered, air covered, corespun yarns and core twisted yarns.

The elastic yarns of some embodiments can be included in a variety of constructions such as knits (warp and weft), wovens, and nonwovens. These are useful in hosiery, leg wear, shirting, intimate apparel, swimwear, bottoms and nonwoven hygiene structures.

The multi-filament separable yarns may be spun and then wound onto a package, also referred to as a cake where the diameter of the package is less than the height. The packages may be unwound and the yarns separated into two or more monofilament multi-component spandex yarns which can be subjected to further textile processes. Specifically, the method includes:

(a) providing a package of bi-component spandex yarn; wherein:
  (1) the bi-component spandex yarn has a sheath and a core;
  (2) the sheath includes a release agent; and
  (3) the yarn includes multiple, separable filaments;
(b) unwinding the spandex yarn; and
(c) separating the multiple, separable filaments.

The further processing may include one or more of the following:

(d) separately, combining the multiple, separable filaments with staple roving fiber to provide core-spun yarn; and
(e) winding the core-spun yarn onto tubes to provide multiple core-spun yarn packages; or
(d) separately, passing the multiple, separable filaments through hollow-tube spindles carrying a non-elastic yarn;
(e) wrapping the multiple, separable filaments with said non-elastic yarn to provide a covered yarn; and
(f) winding the covered yarn onto tubes to provide multiple covered yarn packages, or
(d) separately knitting the multiple, separable filaments to provide multiple fabrics, or
(d) warping/beaming of the multiple, separable filaments to increase the number of thread lines on a warp beam.

Test Methods

The strength and elastic properties of the spandex and films were measured in accordance with the general method of ASTM D 2731-72. Three yarns, a 2-inch (5-cm) gauge length, and a 0-300% elongation cycle were used for each of the measurements. The samples were cycled five times at a constant elongation rate of 50 centimeters per minute. Modulus was determined as the force at 100% (M100) and 200% (M200) elongation on the first cycle and is reported in grams. Unload modulus (U200) was determined at 200% elongation on the fifth cycle and is reported in the tables in grams. Percent elongation at break and force at break was measured on the sixth extension cycle.

Percent set was determined as the elongation remaining between the fifth and sixth cycles as indicated by the point at which the fifth unload curve returned to substantially zero stress. Percent set was measured 30 seconds after the samples had been subjected to five 0-300% elongation/relaxation cycles. The percent set was then calculated as % Set=100(Lf−Lo)/Lo, where Lo and Lf are the filament (yarn) length, when held straight without tension, before (Lo) and after (Lf) the five elongation/relaxation cycles.

Friction Coefficient Measurement

Figure 5:
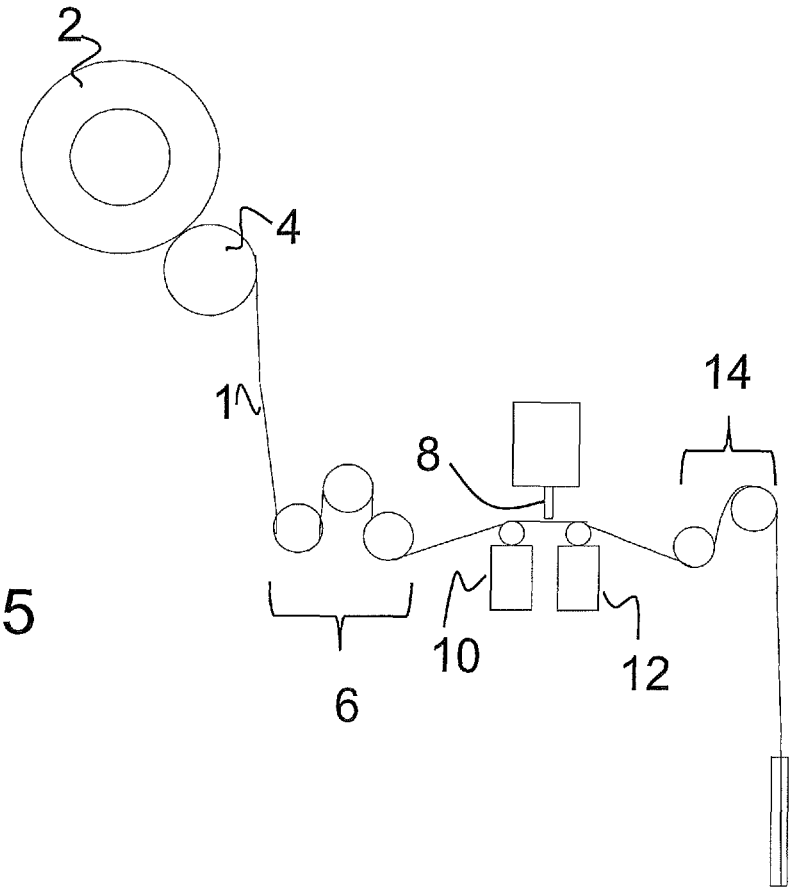
FIG. 5 is schematic of a device for measuring friction.

When measuring friction coefficient, the spandex yarn 1 was directed from a spandex package 2, through a first roll 4 and second rolls 6 to provide extension, around a tensiometer 10, across a friction pin 8, and across a second tensiometer 12, and around another godet 14 as illustrated in FIG. 5.

At a given line speed, the apparent coefficient of friction (t) between the fiber and the metal friction pin can be calculated using the following "capstan" equation:

$$f=\ln(T2/T1)/q$$

where T1 is the tension on the fiber just before the metal friction pin, T2 is the tension on the fiber just after the metal friction pin, and q is the angle of contact in radians between the fiber and the metal friction pin. For all examples, q was standardized at 1.047 radians around a 0.25 inch stainless steel pin. For all examples, the unwind speed was a constant 45 m/min with 2.78× draft from first to last roll.

The tension measurements were made using two tension sensors connected to a real-time data acquisition computer, the tension readings were recorded at 5 cm intervals over a 100 meter length of yarn. Friction coefficients in excess of unity can occur with spandex yarns due to contact deformation and adhesive character of elastomers which are not accounted for by the simplified capstan equation.

Figure 6:
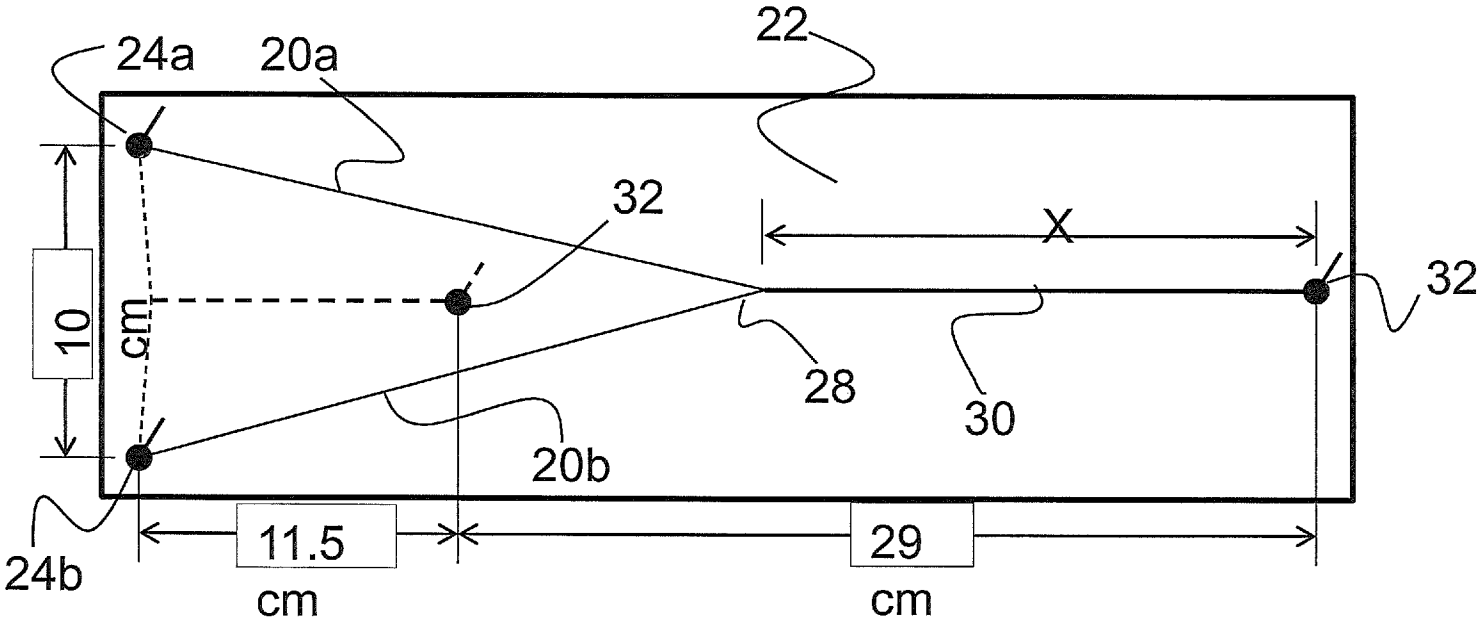
FIG. 6 is a diagram showing yarn placement for measuring cohesive force among filaments in yarn.

Cohesion Index—FIG. 6

To assess the cohesion strength, first remove a sample of multifilament yarn from the package and split filaments by rubbing or stretching. With minimum extension, divide yarn for ~20 cm beyond starting point. Clamp each split end (20*a*, 20*b*) on a board 22 with two pins (24*a*, 24*b*) separated by 10 cm such that the split point 28 is located at 11.5 cm. Each split end (20*a*, 20*b*) and the multiple filament fiber 30 should be extended straight but relaxed. Place a third clamp 32 at the junction point and steadily elongate the yarn until the third clamp 32 reaches 40.5 cm and allow the split point 28 to equilibrate. With a ruler, measure the length of the cohered yarn to the nearest mm and report as cohesion index. Higher values represent a longer cohered length and stronger inter-filament bonding. The arrangement is depicted in FIG. 6.

The features and advantages of the present invention are more fully shown by the following examples which are provided for purposes of illustration, and are not to be construed as limiting the invention in any way.

EXAMPLES

In the illustrated embodiment of the invention, two different polymer solutions are introduced to a segmented, jacketed heat exchanger operating at 40° C.-90° C. The extrusion dies and plates are arranged according to the desired fiber configuration and illustrated in WO 2010/04515A1 for sheath-core. The fiber of the present invention is produced by dry-spinning a PUU polymer from a solution of N,N-dimethylacetamide (CAS number 127-19-50). In order to provide adequate thermal stability to the final fiber, a high-melt PUU polymer is prepared as follows and is used as basis for core and sheath compositions. A polyurethane prepolymer with a capping ratio of 1.7 was prepared by heating a mixture of MDI ((benzene, 1,1-methylenebis[isocyanato-] CAS number [26447-40-5]) and 1800 number average molecular weight PTMEG (poly(oxy-1,4-butanediyl), α-hydro-ω-hydroxy, CAS number 25190-06-1) to 70-90° C. for 2 hours. The pre-polymer was subsequently dissolved to a level of approximately 35% solids in DMAc. The prepolymer solution was extended with a diamine mixture, preferably of ethylenediamine ("EDA") and 2-methylpentamethylenediamine ("MPMD") to increase the 40° C. falling ball solution viscosity to 3600 poise and form a PUU. The hard segments are the polyurethane/urea parts of the polymer chains. The hard segments amount to 5 to 12%, preferably 8 to 10%, of the total weight of the polymer. In the resultant polymer, the soft segments are the polyether/urethane parts of the polymer chain. These soft segments exhibit melting temperatures lower than 25° C.

The polymer solutions containing 30-40% polymer solids are metered through desired arrangement of distribution plates and orifices to form filaments. Distribution plates are arranged to combine polymer streams in a concentric sheath-core arrangement followed by extrusion thru a common capillary. Extruded filaments are dried by introduction of hot gas at 220° C.-440° C. and a gas:polymer mass ratio of at least 10:1 and drawn at a speed of at least 400 meters per minute (preferably at least 600 m/min) and then wound up at a speed of at least 500 meters per minute (preferably at least 750 m/min). Yarns formed from elastic fibers made in accordance with the present invention generally have a tenacity at break of at least 1 cN/dtex, a break elongation of at least 400%, an M200 of at least 0.2 cN/dtex.

Example 1

Talc (Nicron 674) supplied by Rio Tinto Mineral was dispersed in dimethyl acetamide and blended with spandex polymer solution to form a 37% solids solution in DMAc. The solids composition of this solution was 16% talc and balance polymer. The final solution was extruded as the sheath component along with a core solution consisting of the same spandex polymer in a sheath core ratio of 1:9 to form a 44 dtex two-filament yarn. The multi-filament yarn was made from two capillaries located 11 mm apart and passed together through the first ceramic thread guide without additional twisting. Product was drawn away at 490 m/min and wound on a 0.5 kg package at 550 m/min after coating with silicone-based finish oil. Those skilled in the art would recognize the benefit of additional additives such as anti-oxidants, slip agents, and dye-assist agents as necessary to improve commercial value. Product properties including friction and tensile properties are given in Table 2. In order to test split performance, the yarn package was contacted with a driven roll operating at 400 m/min and split ends were directed through guides separated by 58 mm. After passing through guides, monofilament yarns were collected by an aspirator and the process ran the entire package without breaks.

Comp. Example 1

The prepared spandex polymer as a 36% DMAc solution was extruded without modification as the sheath and core component as a 1:9 ratio to form a 44 dtex two-filament yarn. Product was drawn away at 500 m/min and wound on a 0.5 kg package at 490 m/min after coating with silicone-based finish oil. Product properties including friction and tensile properties are given in Table 2.

In order to test split performance, the yarn package was contacted with a driven roll operating at 400 m/min and split ends were directed through guides separated by 58 mm. After passing through guides, monofilament yarns were collected by a waste aspirator and the process ran at most 3-4 minutes between breaks. Yarn from the present example did not meet expectations for commercial utility during splitting and no additional textile processing was performed.

TABLE 2

PHYSICAL PROPERTIES OF SPANDEX FIBERS

| | Units | Ex. 1 | Comp. Ex. 1 |
|---|---|---|---|
| Linear density (w/ finish) | dtex | 44.1 | 44.0 |
| Number of filaments | — | 2 | 2 |
| Friction Coefficient | — | 0.46 | 1.50 |
| Finish level | % w/w | 3.26 | 4.20 |
| Residual DMAC | % w/w | 0.53 | 0.48 |

TABLE 2-continued

PHYSICAL PROPERTIES OF SPANDEX FIBERS

| | Units | Ex. 1 | Comp. Ex. 1 |
|---|---|---|---|
| Tensile Properties | | | |
| % Elongation | % | 525 | 516 |
| Break Force | cN | 35.6 | 38.7 |
| M200 | cN | 4.57 | 4.49 |
| M100 | cN | 2.17 | 2.11 |
| U200 | cN | 1.0 | 1.03 |
| Set | % | 26.9 | 26.3 |

Example 2

Cantal 400 supplied by Canada Talc Ltd., Ontario was dispersed in dimethyl acetamide. The talc slurry and PUU polymer from above were blended to form a 38% solids solution in DMAc. The solids composition of this solution was 16% talc, 84% PUU polymer and product omitted any fusing agent from the sheath formulation. The final solution was extruded as the sheath component along with a core solution consisting of the high-melt PUU polymer in a sheath core ratio of 1:9 to form a 44 dtex three-filament yarn. Product was drawn away at 700 m/min and wound on a package at 800 m/min after coating with silicone-based finish oil. Product properties including friction, cohesion, and tensile properties are given in Table 3.

Comp. Example 2

The prepared PUU polymer as a 36% DMAc solution was extruded without modification as the sheath and core component as a 1:9 ratio to form a 44 dtex three-filament yarn. Product was drawn away at 700 m/min and wound on a package at 800 m/min after coating with silicone-based finish oil. Product properties including friction, cohesion index, and tensile properties are given in Table 3.

TABLE 3

Properties of low-friction, splittable spandex example and comparative case

| | | Comp. Ex. 2 | Ex. 2 |
|---|---|---|---|
| Elongation to Break | % | 480 | 482 |
| Teancity at Break | cN | 34.4 | 35.4 |
| M200 | cN | 5.16 | 5.60 |
| U200 | cN | 1.03 | 0.95 |
| Set | % | 26.1 | 23.8 |
| Residual DMAC | w/w % | 0.33 | 0.25 |
| Friction Coefficient | — | 1.31 | 0.75 |
| Friction Coeff (stdev) | — | 0.135 | 0.033 |
| Cohesion Index | cm | 20.0 | 0.0 |

Example 3

Core Spinning

As shown in FIG. 1, the package 2 of multi-filament spandex yarn from Ex. 1 was supplied to tandem delivery rolls 38 so that each individual filament (1A, 1B) from the package 2 was separated and unwound tangentially to the roller guides 31 and further directed to the corresponding front roll 35 of a spinning position. Product was covered with cotton fiber 3 at a delivery speed of 2-4 meter/min without filament break or yarn entanglement throughout the entire package to provide separate core-spun yarn packages (5A, 5B).

Example 4

Hollow Spindle Covering

Figure 2:
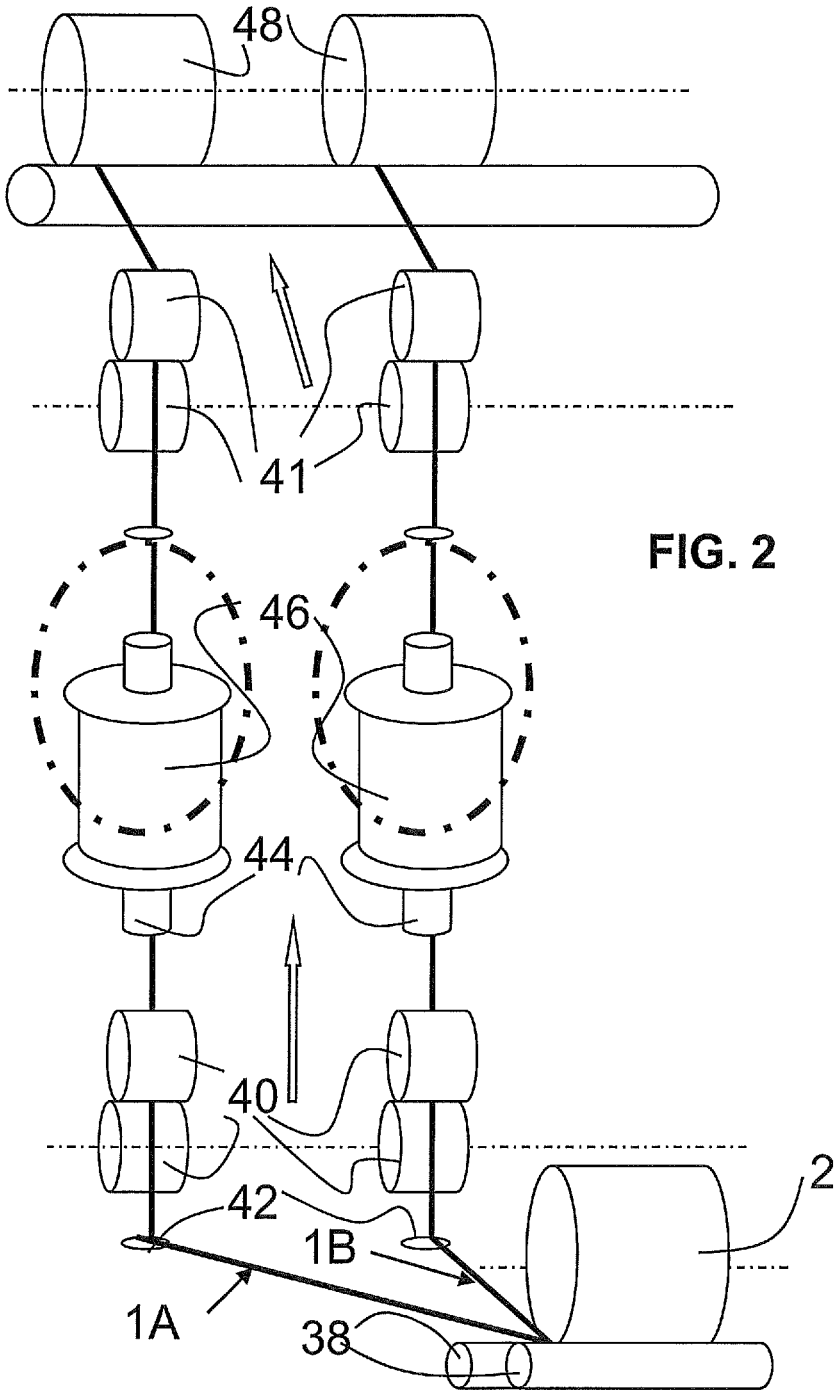
FIG. 2 is a schematic representation of hollow spindle covering process from a multi-end spandex package.

As shown in FIG. 2, the package 2 of multi-filament spandex yarn from Ex. 1 was supplied to tandem delivery rolls 38 so that each individual filament (1A, 1B) and delivered tangentially to individual guide eyelets 42 for the corresponding spinning position. The separated mono-filament yarns (1A, 1B) separately passed from second delivery rollers 40, then pass through hollow-tube spindles 44 carrying a non-elastic yarn package outside 46. The spinning action of the spindle releases the non-elastic yarn and wrapped around the monofilament yarn and is taken up by third delivery rollers 41 and is collected as a covered package 48 for further processing. The linear speed of the delivery roller was tested at a range of 6-10 meter per minute without breaks or yarn entanglement throughout the entire package.

Example 5

Circular Knitting

Figure 3:
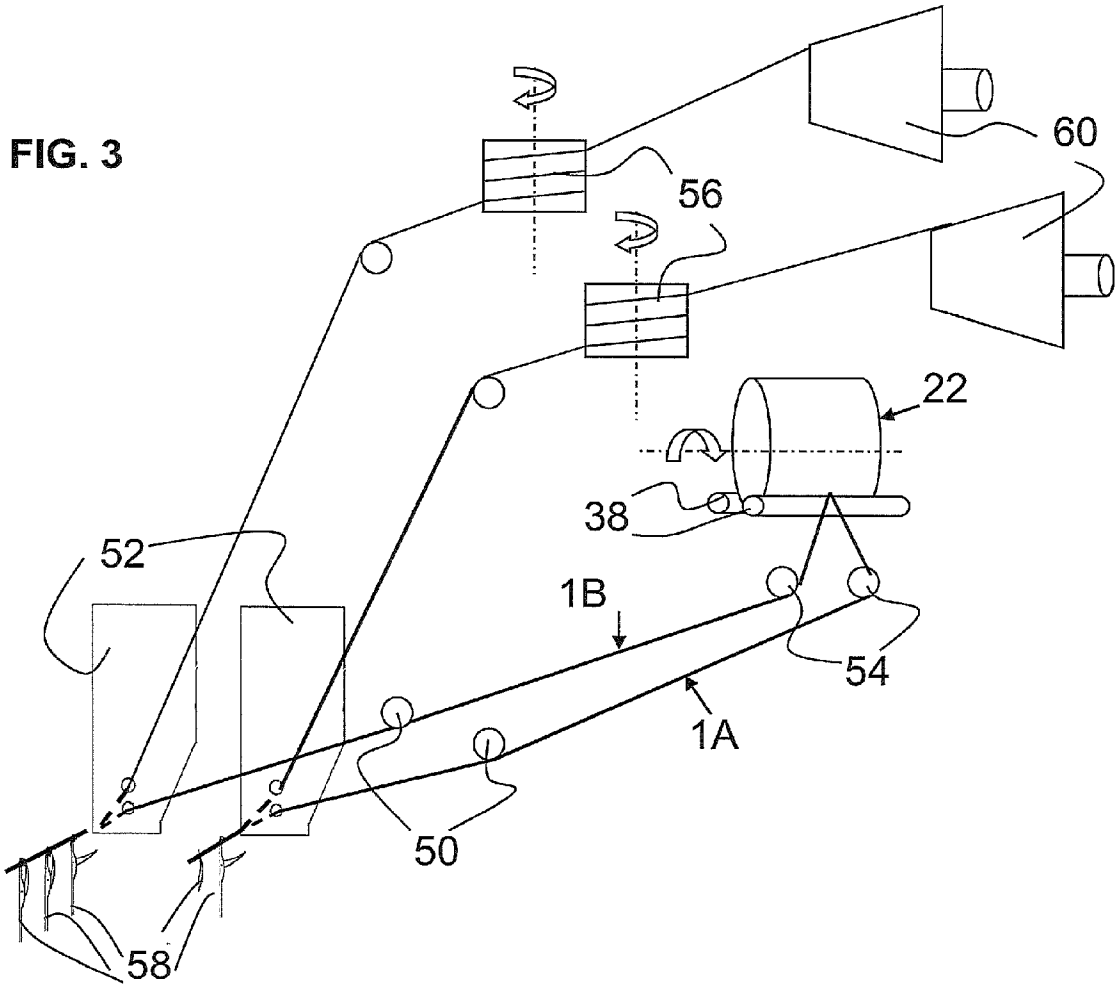
FIG. 3 is a schematic representation of a circular knitting process using from a multi-end spandex package.

An example product was a 44 dtex spandex having 2 filaments wound onto a tube to provide a multi-end spandex package 2. As shown in FIG. 3, the multi-end package 2 was delivered by two delivery rollers 38 and separated into 2 filaments and unwound tangentially. the separated filaments (1A, 1B) each became 22 dtex and were directed thru individual stop motion 54, roller guide 50, feeder 52 to the knitting needles 58 and knitted with 71 denier/68 fil polyamide 60 with a speed control apparatus 56 on a 28 gauge circular knitting machine (Vignoni, model Venis E). The knitting machine speed was 35 rpm corresponding to the spandex delivery speed of 75 meter/minute. The product found no yarn entanglement and no breakage throughout the delivery and knitting process.

For comparison, a standard 22 dtex spandex fiber sample (LYCRA® fiber T169B) was also knit with the same polyamide 71 dex/68 f at a delivery speed of 75 meter/min. In this case, twice the number of spandex packages was used to create the equivalent number of ends.

After knitting, fabric was processed through normal finishing process, namely: scouring, dyeing, washing and drying on stenter. The process details were:

Step 1: Scouring at 90° C.×20 min with 2.0 gram/liter soda ash (Sesoda Corp., China), Imacol S (from Clariant Chemicals Co., Ltd.), Humectol LYS (from Clariant) and B-30 (from Yue Fa Co. Ltd., Taiwan). The fabrics were rinsed with water 2 times, followed by hot water at 60° C.×10 min and 2 more times cool water rinse.

Step 2: Dyeing at 100° C.×30 min with the following dyes and auxiliaries based on weight of fabric (owf):

| | | |
|---|---|---|
| a. | Nylosan Yellow SL from Clariant | 0.087% |
| b. | Lanasyn Turquoise M-5G from Clariant | 0.14% |
| c. | Nylosan Blue SR dye from Clariant | 0.38% |
| d. | Sandogen NH from Clariant | 0.75 g/l |
| e. | Imacol S from Clariant | 0.5 g/l |
| f. | Sandacid VS from Clariant | 0.3 g/l |
| g. | B-30 from Yue Fa Co. Ltd | 0.1 g/l |
| h. | Rinse with 4 times cold water after dyeing | |

Step 3: Drying on stenter machine (Krantz model K30) with 130° C.×90 sec

Fabric performance was tested and was rated as comparable. The uniformity was also rated according to AATCC Method 178 and rated as comparable when having top lighting while the invention was slightly better than comparison fabric under transmitted lighting.

TABLE 4

Fabric properties with spandex from Example 1 and control

| Combination Yarn | width (cm) | weight (g/m2) | Elongation % (L × W) | Shrinkage % | Uniformity Rating: Top Lighting Fabric Face/Back | Uniformity Rating: Transmitted Light Fabric face |
|---|---|---|---|---|---|---|
| Nylon 71/68 + Ex. 1 | 60 | 174 | 133 × 203 | −2.7 × −1.7 | 7.8/6.2 | 2.5 |
| Nylon 71/68 + 22/1 spandex | 61 | 171 | 118 × 186 | −1.8 × −0.7 | 7.8/6.5 | 1.6 |

Example 6

Elastic Yarn Beaming

Figure 4:
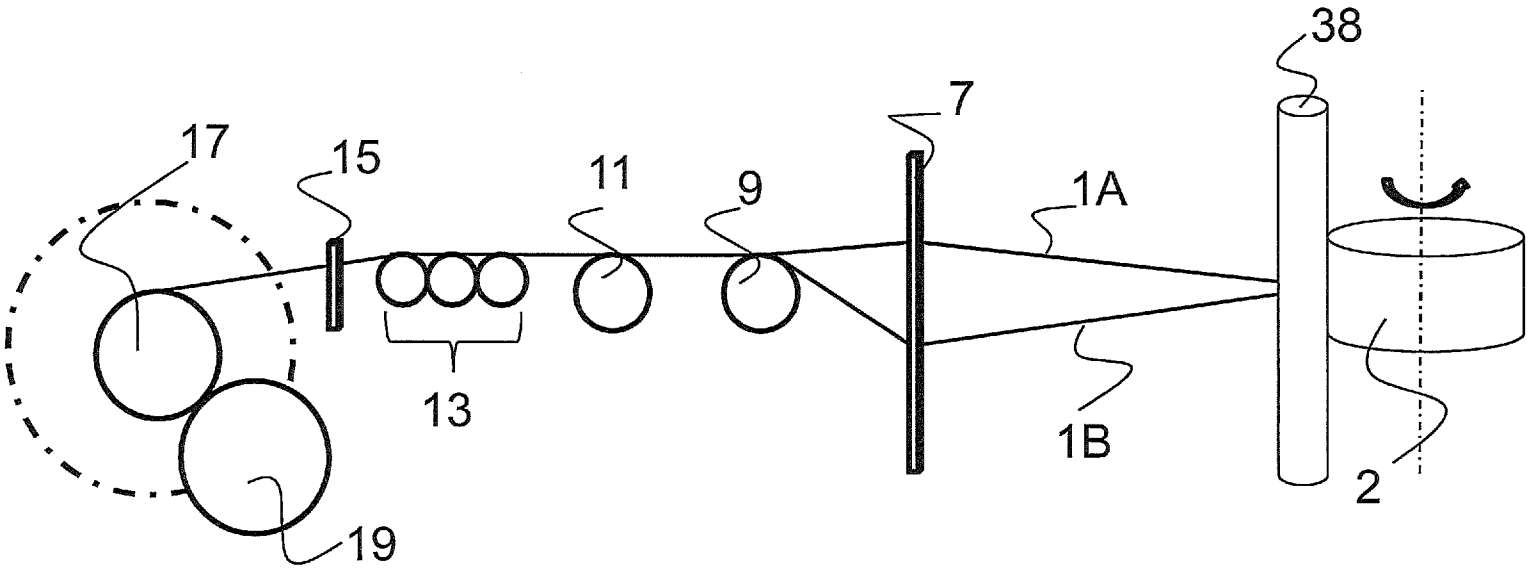
FIG. 4 is a schematic representation of a warping/beaming process using a multi-end spandex package.

FIG. 4 illustrates a typical warping system for elastic yarn. The product is driven by a delivery roll and is separated into two threadlines, yarns 1A and 1B are delivered tangentially, passing through to a condenser reed 7 (a board of yarn eyelet guides) to a condensing roll 9. The sheet of yarns, range from 500-1000 ends depends on yarn size (dtex) and gauge (needles per inch) of warp knitting machine, is then tensioned (by passing from a pre-stretch roll 11 and tensionmeter 13, passing through a reed 15 and wound up onto a sectional warp beam 17 for subsequent warp knitting process. The typical delivery speed of the creel is in a range of 150-300 meter/min provided by a pressure roll 19.

While there have been described what are presently believed to be the preferred embodiments of the invention, those skilled in the art will realize that changes and modifications may be made thereto without departing from the spirit of the invention, and it is intended to include all such changes and modifications as fall within the true scope of the invention.

What is claimed is:

1. An article comprising a package of bi-component polyurethane yarn;

wherein:

(a) said bi-component polyurethane yarn has a sheath and a core;

(b) said sheath includes a release agent blended into the sheath in an amount from about 1% to about 50% by weight of the sheath; and (c) said yarn includes multiple, separable filaments and said yarn does not include a fusing additive in said sheath.

2. The article of claim 1 wherein said yarn includes 2 to 10 separable filaments.

3. The article of claim 1, wherein said yarn is a solution-spun yarn.

4. The article of claim 1, wherein said core comprises:

(1) a polyurethane, (2) a blend of at least one polyurethane and at least one polyurethane-urea or, (3) a polyurethane-urea.

5. The article of claim 1, wherein the release agent is selected from the group consisting of at least one crystalline material which fractures, at least one low-friction polymer, and combinations thereof.

6. The article of claim 1, wherein said release agent is selected from the group consisting of mica, graphite, carbon black, molybdenum disulfide, talc, boron nitride, fumed silica, a wax, and mixtures thereof.

7. The article of claim 1, wherein said release agent comprises a fluorine-containing polymer.

8. The article of claim 1, wherein said sheath comprises the release agent in an amount of about 10% to about 25% by weight of the sheath.

9. The article of claim 1, wherein said sheath comprises about 1% to about 50% by weight of the yarn.

10. The article of claim 1, wherein said sheath comprises about 10% to 20% by weight of the yarn.

11. A method comprising:

(a) providing a package of bi-component polyurethane yarn;

wherein:

(1) said bi-component polyurethane yarn has a sheath and a core;

(2) said sheath includes a release agent blended into the sheath in an amount from about 1% to about 50% by weight of the sheath; and (3) said yarn includes multiple, separable filaments but does not include a fusing additive in said sheath;

(b) unwinding said polyurethane yarn; and (c) separating said multiple, separable filaments.

12. The method of claim 11, further comprising:

(d) separately, combining said multiple, separable filaments with staple roving fiber to provide core-spun yarn; and (e) winding said core-spun yarn onto tubes to provide multiple core-spun yarn packages.

13. The method of claim 11, further comprising:

(d) separately, passing said multiple, separable filaments through hollow-tube spindles carrying a non-elastic yarn;

(e) wrapping said multiple, separable filaments with said non-elastic yarn to provide a covered yarn; and (f) winding said covered yarn onto tubes to provide multiple covered yarn packages.

14. The method of claim 11, further comprising (d) separately knitting said multiple, separable filaments to provide multiple fabrics.

15. The method of claim 11, further comprising (d) warping/beaming of said multiple, separable filaments to increase the number of thread lines on a warp beam.

* * * * *